US005996732A

United States Patent [19]

Burger et al.

[11] Patent Number: 5,996,732

[45] Date of Patent: Dec. 7, 1999

[54] MUFFLER FOR A TWO-STROKE INTERNAL COMBUSTION ENGINE

[75] Inventors: Wolf Burger, Böblingen; Gerhard Stoll, Winnenden, both of Germany

[73] Assignee: Andreas Stihl AG & Co., Waiblingen, Germany

[21] Appl. No.: 09/245,568

[22] Filed: Feb. 5, 1999

[30] Foreign Application Priority Data

Feb. 7, 1998 [DE] Germany ..... 298 02 099 U

[51] Int. Cl.[6] ..... F01N 3/02

[52] U.S. Cl. ..... 181/230; 181/231; 181/282

[58] Field of Search ..... 181/230, 231, 181/240, 255, 282; 60/299, 302

[56] References Cited

U.S. PATENT DOCUMENTS 5,183,977 2/1993 Horitani ..... 181/282
5,883,342 3/1999 Wolpert ..... 181/230

FOREIGN PATENT DOCUMENTS 0664380 7/1995 European Pat. Off. .
4206839 10/1992 Germany .

*Primary Examiner*—Khanh Dang
*Attorney, Agent, or Firm*—Robert W. Becker & Associates

[57] ABSTRACT

A muffler for a two-stroke internal combustion engine has a housing enclosing a hollow space and having an exhaust gas inlet and an exhaust gas outlet. Shaped sheet metal members are mounted in the housing and define an exhaust gas flow channel. The flow channel extends at least over a portion of its length in a plane of the sheet metal members. A first one of the sheet metal members has a projecting portion projecting from the plane of the sheet metal members and forming a connector of the flow channel. The connector communicates with the exhaust gas inlet. A second one of the sheet metal members has a projecting portion projecting from the plane of the sheet metal members and forming an end portion of the flow channel opening into the hollow space of the housing.

20 Claims, 3 Drawing Sheets

MUFFLER FOR A TWO-STROKE INTERNAL COMBUSTION ENGINE

BACKGROUND OF THE INVENTION

The present invention relates to a muffler for a two-stroke internal combustion engine, especially for a portable working tool such as a motor chain saw, a cut-off saw, hedge trimmer, cutter etc., wherein the muffler comprises a housing having an exhaust gas inlet and an exhaust gas outlet and a flow channel formed by shaped sheet metal members inserted into the housing, whereby the flow channel extends at least over a portion of its length along the plane of the sheet metal members.

From European patent application 0 664 380 a muffler is known which is comprised of an inner shell of two sheet metal members resting on one another and a housing shell comprised of two outer sheet metal members resting on one another. The inner shell has a circumferential edge which is secured between clamping depressions of the housing shell in a spring-elastic manner. An exhaust gas inlet and an exhaust gas outlet are positioned at opposed sides of the housing in the area of the connecting surfaces of the two outer sheet metal members and between the exhaust gas inlet and the exhaust gas outlet the flow channel extends that is formed by a respective shaping of the inner sheet metal members or by inserted tube members. The extension of the flow channel between the exhaust gas inlet and exhaust gas outlet is meanderlike.

In German Patent 42 06 839 a muffler for an internal combustion engine is disclosed whereby in the muffler a catalyst is arranged. The muffler comprises a two-part housing, i.e., a muffler body and a muffler cover which are detachably connected to one another. In the housing a thermal and acoustic insulation is provided which rests at the inner upper surface of the muffler cover. At the inner upper surface of the thermal and acoustical insulation layer a catalyst layer comprised of a catalyst fabric is positioned. A porous securing device is provided in the muffler cover which forces the thermal and acoustic insulation layer as well as the catalyst layer against the muffler cover whereby the porous securing device has an inner surface along which the exhaust gas will flow.

It is an object of the present invention to provide a muffler of the aforementioned kind that is of a simple design but, despite a small constructive size, provides minimal noise emission.

SUMMARY OF THE INVENTION

According to the present invention, one of the sheet metal members has a projecting portion projecting from the plane of the sheet metal members. This portion provides a connector of the flow channel that communicates with the exhaust gas inlet. The other sheet metal member has a projecting portion projecting from the plane of the sheet metal members which is an end portion of the flow channel that opens into the hollow space of the housing.

The decisive advantage of the invention is that the muffler is comprised of only few components so that it can be produced in a simple and inexpensive manner and furthermore reduces the noise emission considerably.

Expediently, the muffler is fastened directly to the cylinder housing of the two-stroke internal combustion engine whereby a compact design is achieved in that the exhaust gas inlet of the muffler is arranged a bottom wall of the bottom half of the housing extending parallel to the separating plane of the housing. Furthermore, it is advantageous that the connector and/or the end portion of the flow channel extend at least substantially perpendicularly to the plane of the sheet metal members. This design enables the connector to extend directly into the vicinity of the exhaust gas inlet and thus does not require additional connecting pieces. The perpendicular extension of the end portion has the advantage that the exhaust gas flow will impinge on the wall of the top half of the housing so that this part of the muffler acts as a reflection dampening device.

The flow channel between the connector and the end portion forms an oscillating tube for which purpose the flow channel is preferably formed with a plurality of curved portions over its entire length. According to a preferred embodiment, in the flow direction of the exhaust gas all curved portions are curved in the same direction, and between the curved portions straight portions of the flow channel are arranged. In this manner, the flow channel can have a length which is approximately three times the length of the housing.

It is especially beneficial when the sheet metal members are embodied as deep-drawn parts so that in one machining step all required shapes for the flow channel can be produced. The flow channel is preferably formed by congruent bulges of the sheet metal members extending symmetrically to both sides of the separating plane of the housing. The cross-section of the flow channel is designed such that the oscillating tube is optimized whereby preferably the cross-section of the flow channel between the connector and the end portion is constant. The cross-section of the flow channel should be substantially circular. For reducing the exhaust gas emissions, it is especially advantageous that at least one of the sheet metal members at the wall facing the flow channel is provided with a coating of a catalytic material. In this manner, a combination of optimized oscillating tube and catalyst is provided whereby, because of the extended guiding of the exhaust gas flow along the oscillating tube, a sufficient surface for excellent catalytic converting is provided.

Alternative to a coating of the inner wall of the oscillating tube with a catalytically active material, the oscillating tube may have inserted therein a knit wire mesh or a corrugated sheet metal insert which are provided with a catalytically active material.

In order to eliminate additional fastening means for the sheet metal members within the housing, it is expedient to clamp the sheet metal members between the flange rims of the top half and the bottom half. In this manner a fixation of the sheet metal members simultaneously to the closing of the housing by connecting the flange rims of the top half and the bottom half is realized. The housing is embodied as a Helmholtz resonator whereby the hollow space in the housing is divided by the sheet metal members into two chambers and these chambers communicate by openings in the sheet metal members.

As an exhaust gas outlet it is preferred to provide a tube that penetrates the wall of the top half. This tube extends according to a preferred embodiment substantially at a right angle to the orientation of the end portion of the flow channel.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 4.

Figure 1:
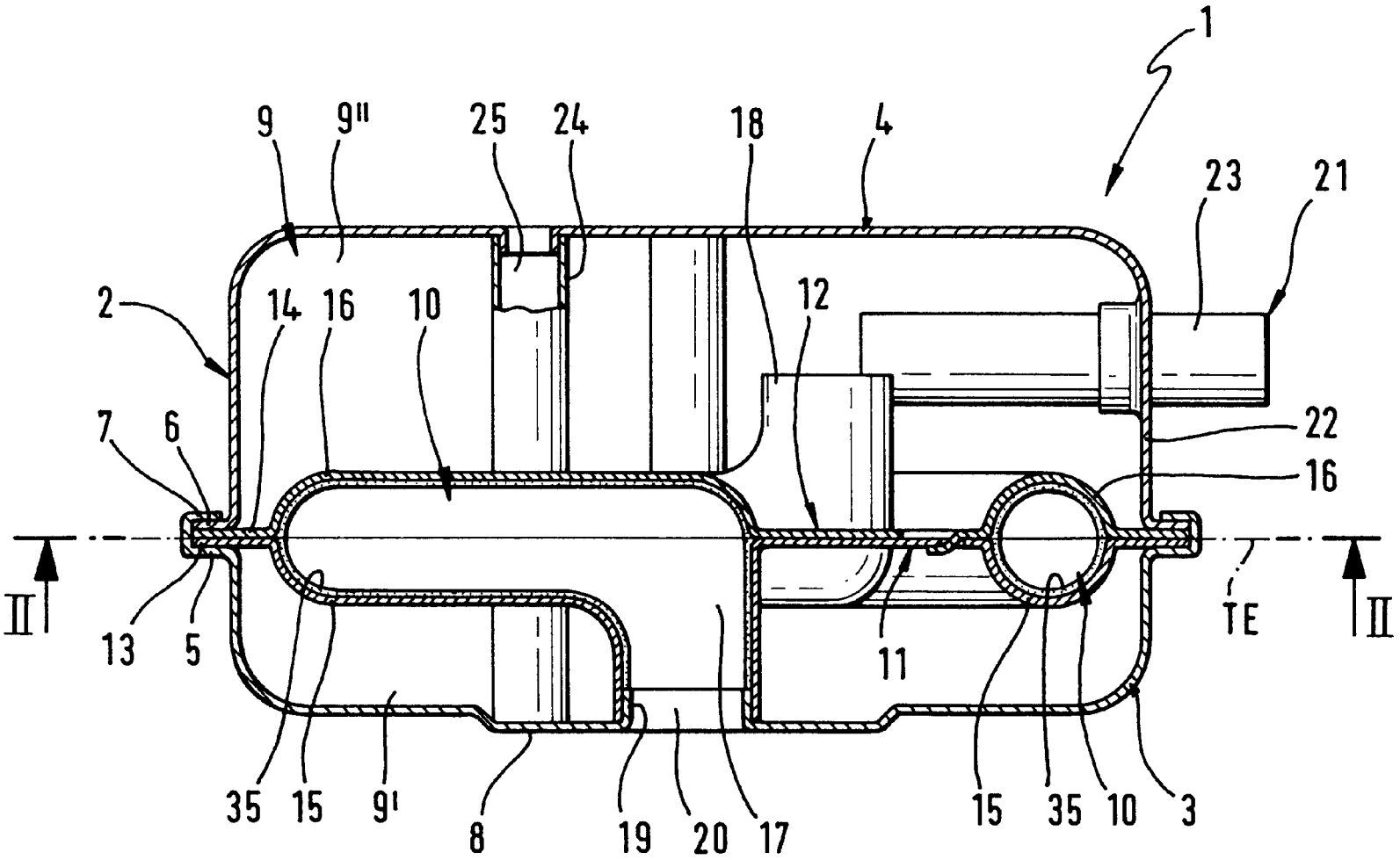
FIG. 1 is a section of the muffler in the area of the exhaust gas inlet.

FIG. 1 shows a section of the muffler 1 which is comprised of a bottom half 3 and a top half 4 forming housing 2. The bottom half 3 has a flange rim 5 and the top half 4 has a flange rim 6 by which the bottom half and the top half are connected to one another, whereby the housing is closed by crimping one end 7 of the flange rim 5 behind the flange rim 6. The separating line between the bottom half 3 and the top half 4 is indicated as the separating plane TE.

Figure 2:
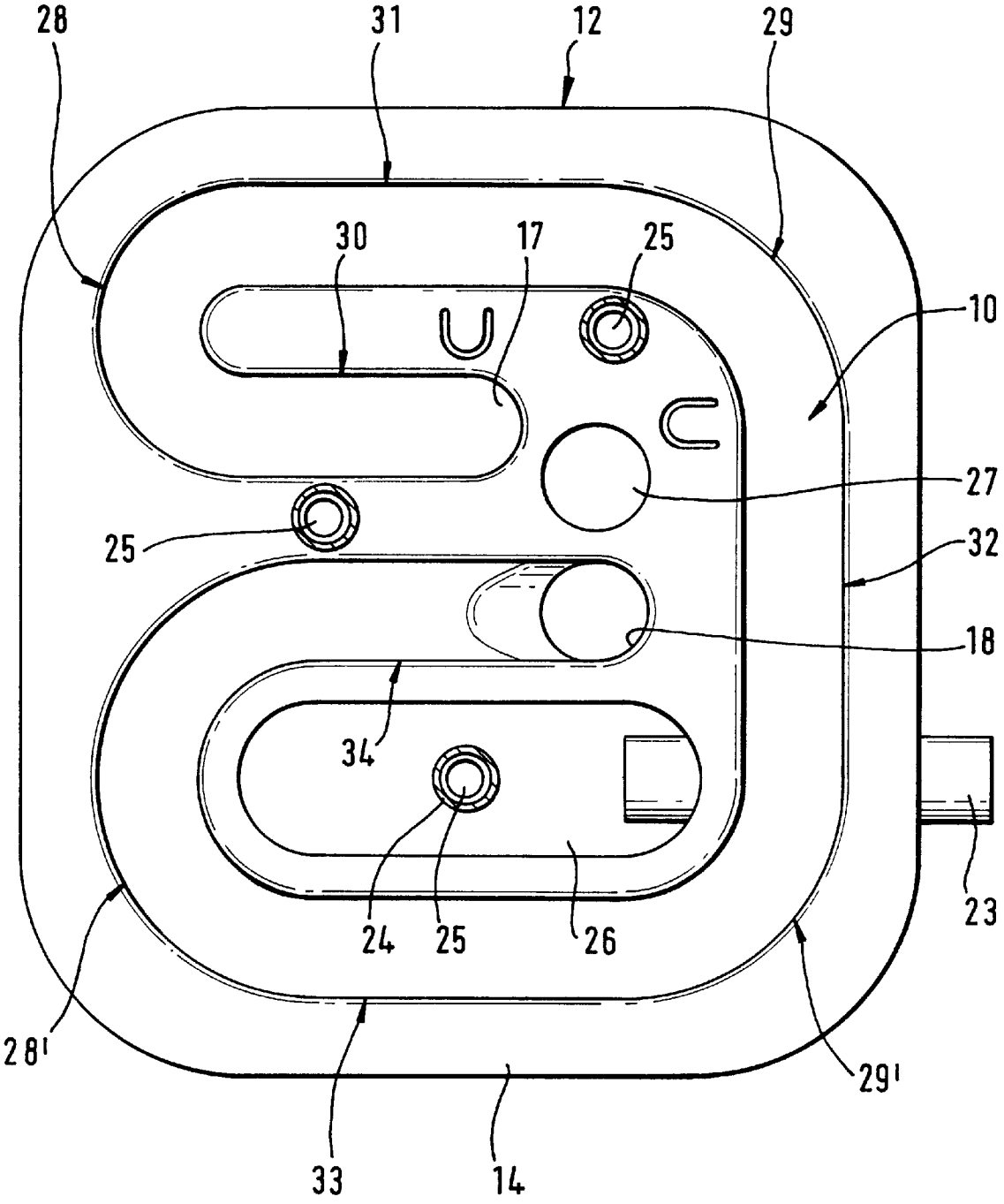
FIG. 2 is a view taken in the section plane 11—11 of FIG. 1.

Along the separating plane TE two sheet metal members 11, 12 extend whereby the first sheet metal member 11 has an edge 13 and the second sheet metal member 12 has an edge 14. Both edges 13, 14 extend respectively between the flange rims 5, 6 of the bottom half 3 and the top half 4 so that the sheet metal members 11, 12 are clamped between the flange rims 5, 6 by crimping the end 7. Within the housing 2 a hollow space 9 is formed which is divided by the sheet metal members 11, 12 extending in the separating plane TE into chambers 9', 9". These chambers 9', 9" communicate by openings 26, 27 with one another (see FIG. 2). Sleeves 24 are provided in the hollow space 9 which extend between the opposing walls of the bottom half 3 and the top half 4 so that in this manner openings for penetration by fastening screws or bolts are provided. FIG. 2 shows that a total of three such sleeves 24, respectively, openings 25 are provided.

As can be seen in FIG. 1, the sheet metal members 11, 12 have a certain shape which can be produced, for example, by deep-drawing. The first sheet metal member 11 has a bulge 15 which projects from the separating plane TE in the direction toward the bottom half 3. A congruent embodiment is provided at the second sheet metal member 12 having a bulge 16 extending toward the top half 4. As can be seen in the right half of FIG. 1, the bulges 15, 16 of the sheet metal members 11, 12 define a flow channel 10 with a circular cross-section. The extension of the flow channel 10 along the separating plane TE can be seen in the representation of FIG. 2.

As can be seen in the sectional view shown in FIG. 1, a wall 8, which extends parallel to the separating plane TE, is provided at the bottom half 3 of the housing 2 and has an exhaust gas inlet 20 that is delimited by an annular collar 19 which extends into the housing and is formed as a unitary part thereof. The first sheet metal member 11 is shaped such that a connector 17 extends at a right angle to the separating plane TE and extends to the exhaust gas inlet 20 so that the connector 17 with its forward end surrounds the annular collar 19. The inner end of the flow channel 10 is formed by the end portion 18 which is also positioned at a right angle to the separating plane TE. The opening through which the exhaust gas flow exits the end portion 18, is positioned at a side facing the top half 4 so that the exhaust gas flow exiting from the end portion 18 will impinge on the inner side of the top half 4. In the lateral wall 22 of the top half 4 a tube 23 is arranged which is parallel to the separating plane TE. A portion of the tube 23 is positioned external to the housing 2 and another portion of the tube is positioned within the housing 2. This tube 23 forms the exhaust gas outlet 21.

The walls of the bulges 15, 16 of the flow channel 10 are provided with a coating 35 for reducing the exhaust gas emission.

Figure 3:
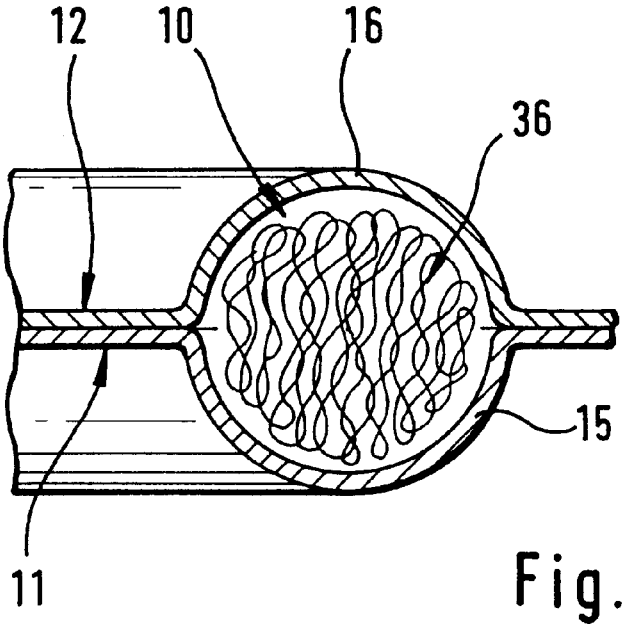
FIG. 3 is an enlarged representation of the cross-section of the oscillating tube with knit wire mesh insert.

The representation of FIG. 2 shows that the connector 17 first has connected thereto a straight portion 30 of the flow channel 10 whereby a semi-circular curved portion 28 follows that is then, in turn, followed by another straight portion 31. A further straight portion 32 is connected by a curved portion 29, which extends over 90°, to the portion 31, and a further curved portion 29', which also extends over a quarter circle, follows. Another straight portion 33 follows, and a further semi-circular curved portion 28' and another straight portion 34 are connected downstream in sequence whereby the latter portion then has a transition into the end portion 18. This design of the flow channel 10 provides for a flow channel length which corresponds approximately to three times the length of the housing 2. Furthermore, FIG. 2 shows that the opening 26 in the sheet metal members 11, 12 has an elongate shape and is substantially greater than the other opening 27 with circular cross-section. FIG. 3 shows an enlarged representation of a cross-section of the flow channel 10 formed between the curved walls of the bulges 15, 16 of the sheet metal members 11, 12. A knit wire mesh 36 is arranged in the flow channel 10 and is coated with a catalytically active material.

Figure 4:
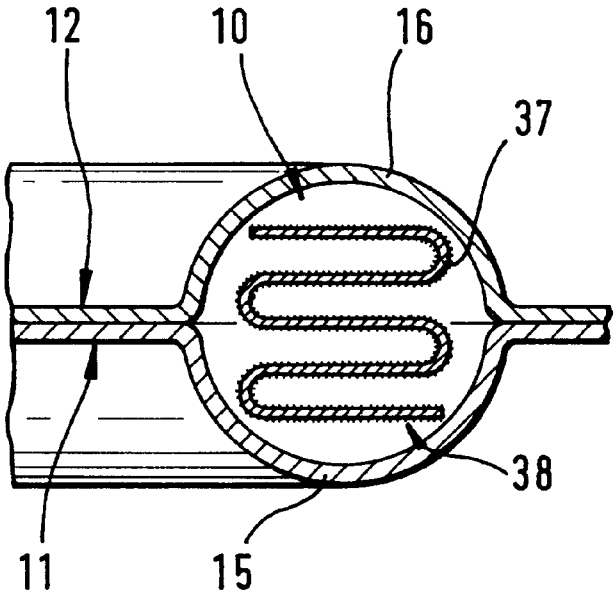
FIG. 4 is an embodiment variant of FIG. 3 with a corrugated sheet metal insert.

FIG. 4 shows an embodiment of a flow channel 10 having arranged therein a corrugated sheet metal insert 37. The surface of the sheet metal insert 37 is coated with a layer 38 comprised of catalytic active material.

The specification incorporates by reference the disclosure of German priority document 298 02 099.8 of Feb. 7, 1998.

The present invention is, of course, in no way restricted to the specific disclosure of the specification and drawings, but also encompasses any modifications within the scope of the appended claims.

What is claimed is:

1. A muffler for a two-stroke internal combustion engine, said muffler comprising:

a housing (2) enclosing a hollow space (9) and having an exhaust gas inlet (20) and an exhaust gas outlet (21);

shaped sheet metal members (11, 12) mounted in said housing (2) and defining an exhaust gas flow channel (10);

said flow channel (10) extending at least over a portion of a length thereof in a plane of said sheet metal members (11, 12);

wherein a first one of said sheet metal members (11) has a projecting portion projecting from said plane of said sheet metal members (11, 12) and forming a connector (17) of said flow channel (10);

said connector (17) communicating with said exhaust gas inlet (20);

wherein a second one of said sheet metal members (12) has a projecting portion (18) projecting from said plane of said sheet metal members (11, 12) and forming an end portion (18) of said flow channel (20) opening into said hollow space (9) of said housing (2).

2. A muffler according to claim 1, wherein two of said sheet metal members (11, 12) are provided.

3. A muffler according to claim 1, wherein said housing (2) is comprised of a bottom half (3) having a flange rim (5) and a top half (4) having a flange rim (6), wherein said flange rims (5, 6) are connected to one another to define said hollow space (9) and extend in a separating plane (TE) of said housing (2).

4. A muffler according to claim 3, wherein said bottom half (3) has a bottom wall (8) extending parallel to said separating plane (TE) and wherein said exhaust gas inlet (20) is mounted in said bottom wall (8).

5. A muffler according to claim 1, wherein at least one of said connector (17) and said end portion (18) of said flow channel (10) extends perpendicularly to said plane of said sheet metal members (11, 12).

6. A muffler according to claim 1, wherein said connector (17) is directly connected to said exhaust gas inlet (20).

7. A muffler according to claim 1, wherein said flow channel (10) has multiple curved portions (28, 28', 29, 29') over its length.

8. A muffler according to claim 7, wherein said curved portions (28, 28', 29, 29') have an identical direction of curvature.

9. A muffler according to claim 7, wherein said flow channel (10) has multiple straight portions (30–34) positioned between said curved portions (28, 28', 29, 29').

10. A muffler according to claim 1, wherein said flow channel (10) has a length that is approximately three times a length of said housing (2).

11. A muffler according to claim 1, wherein said flow channel (10) is formed by congruent bulges (15, 16) of said sheet metal members (11, 12), said bulges (15, 16) extending symmetrically in opposite directions relative to said separating plane (TE).

12. A muffler according to claim 1, wherein said flow channel (10) has a constant cross-section between said connector (17) and said end portion (18).

13. A muffler according to claim 12, wherein said cross-section of said flow channel (10) is at least part circular.

14. A muffler according to claim 1, wherein at least one of said sheet metal members (11, 12) has a catalytic coating (35) at a side facing said flow channel (10).

15. A muffler according to claim 1, further comprising at least one corrugated sheet metal insert (37) mounted in said flow channel (10), wherein said insert (37) is a support for a catalytic material (38).

16. A muffler according to claim 1, further comprising at least one knit wire mesh (36) coated with a catalytic material and mounted on said flow channel (10).

17. A muffler according to claim 1, wherein said sheet metal members (11, 12) are embodied as deep-drawn parts.

18. A muffler according to claim 1, wherein said sheet metal members (11, 12) are clamped between said flanged rims (5, 6) of said top half (4) and said bottom half (3).

19. A muffler according to claim 18, wherein said hollow space (9) in said housing (2) is divided by said sheet metal members (11, 12) into two chambers (9', 9"), wherein said sheet metal members (11, 12) have openings (25), and wherein said two chambers (9', 9") are connected to one another by said openings (25).

20. A muffler according to claim 1, wherein said exhaust gas outlet (21) comprises a tube (23) penetrating a wall (22) of said top half (4), wherein said tube (23) extends substantially perpendicularly to said end portion (18) of said flow channel (20).

* * * * *